US007722398B2

(12) United States Patent
Ma

(10) Patent No.: US 7,722,398 B2
(45) Date of Patent: May 25, 2010

(54) ELECTRICAL CONNECTOR ASSEMBLY WITH A PROTECTING SECTION OVER A FLEXIBLE PRINTED CIRCUIT BOARD CONNECTED THERETO

(75) Inventor: Wen-Qiang Ma, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/082,802

(22) Filed: Apr. 14, 2008

(65) Prior Publication Data

US 2008/0254652 A1 Oct. 16, 2008

(30) Foreign Application Priority Data

Apr. 13, 2007 (CN) ..... 2007 2 0035991
Jun. 11, 2007 (CN) ..... 2007 2 0039788

(51) Int. Cl.
*H01R 13/648* (2006.01)

(52) U.S. Cl. ..... 439/607.04; 439/67; 439/493

(58) Field of Classification Search ..... 439/67, 439/77, 493, 607, 71, 607.01, 607.04, 607.13, 439/607.14, 492; 174/254, 117 F, 117 FF
See application file for complete search history.

(56) References Cited

U.S. PATENT DOCUMENTS 7,168,959 B2 1/2007 Kuo et al.
7,255,600 B2 * 8/2007 Ma ..... 439/607
7,301,104 B2 * 11/2007 Miura et al. ..... 174/254
7,402,082 B2 * 7/2008 Zhang ..... 439/607
2007/0238357 A1 10/2007 Wang
2008/0007933 A1 1/2008 Ma
2008/0026626 A1 1/2008 Ma
2008/0050941 A1 2/2008 Zhang

* cited by examiner

*Primary Examiner*—Xuong M Chung-Trans
(74) *Attorney, Agent, or Firm*—Ming Chieh Chang; Wei Te Chung; Andrew C. Cheng

(57) ABSTRACT

A shielded connector assembly for interconnecting a camera module (50) to a printed circuit board (not shown) via a flexible printed circuit board (70) comprises a shielded shell (10) having a receiving space (100), a spring plate (30) assembled in the shielded shell, a flexible printed circuit board secured in the receiving space and abutting against the top surface of the spring plate. The flexible printed circuit board includes a first section (701) received in the receiving space and second section (700) extending beyond the receiving space. The fist section at least defines a plurality of conductive pads (708) to contact with pads (not shown) formed on the bottom face of the camera module. A protecting element (702) is disposed on top surface of the first section and encloses the conductive pads and disconnects therewith so as to prevent the flexible printed circuit board from being scraped during production and assemble and the like.

8 Claims, 7 Drawing Sheets

ELECTRICAL CONNECTOR ASSEMBLY WITH A PROTECTING SECTION OVER A FLEXIBLE PRINTED CIRCUIT BOARD CONNECTED THERETO

BACKGROUND OF THE INVENTION

1. Field of the Invention

The present invention relates to an electrical connector assembly, and more particularly to an electrical connector assembly for interconnecting an electronic module such as a camera module for use with a cellular phone or the like to an electrical member such as a printed circuit board via a flexible printed circuit board. At least a protecting section is formed on the flexible printed circuit board to prevent pads formed on the printed circuit board from being scraped accidentally.

2. Description of the Related Art

Conventionally, electronic modules such as a camera module for use with a cellular phone has to be securely maintained in electrical connection with an electronic member such as a printed circuit board. Therefore, a camera socket is dimensioned to securely receive a camera module therein. Consequently, the camera module is electrically connected with the printed circuit board via the shielded connector.

In order to comply with a miniaturization trend of electrical connectors, a flexible printed circuit board is used in said electrical connector to reduce the height of the electrical connector and provide a reliable electric path between a camera module and a printed circuit board.

U.S. Pub No. 2007/0238357, published on Oct. 11, 2007, discloses an electrical connector assembly for interconnecting a camera module and a printed circuit board via a flexible printed circuit board. Said electrical connector assembly includes a shielded shell, a flexible printed circuit board received in the shielded shell and a supporting member sandwiched between the shielded shell and the printed circuit board. The shielded shell has a receiving space and defines two pairs of sidewalls extending upwardly. Each of an opposite sidewalls defines a resilient portion projecting towards the receiving space for retaining the camera module. The flexible printed circuit board is received in the receiving space also for electrically connecting the camera module. The supporting element upholds the flexible printed circuit board. When the camera module is assembled in the receiving space from above, the flexible printed circuit board is sandwiched between the camera module and supporting element, meanwhile, the pads formed on upper surface of the flexible printed circuit board contact with the pads formed on the bottom face of the camera module so as to transfer the signal of the camera module to printed circuit board.

It is well know that flexible printed circuit board is made of soft material and is easy to bend and distort, accordingly, the flexible printed circuit board, especially the pads formed thereon to electrically connect with the pads formed on the bottom of the camera module, is easy to be scraped during production, assembly and so on. Accordingly, when camera module is assembled in the receiving space of the shielded shell, there has a possible that the pads formed on the flexible printed circuit board will not contact with the pads formed on the bottom of the camera module due to the damage or deformation. As a result, a reliable electrical path between the camera module and printed circuit board is not provided.

Thus, there is a need to provide an improved electrical connector assembly to overcome the above-mentioned problems.

BRIEF SUMMARY OF THE INVENTION

It is an object of the present invention to provide an electrical connector assembly having a protecting section on the flexible circuit board so as to prevent pads formed on the flexible printed circuit board from being scraped and provides a reliable electric path between two electrical elements.

In order to achieve the objective above, an electrical connector assembly in accordance with a first embodiment of the present invention includes a shielded shell, a spring plate and a flexible printed circuit board. The shielded shell includes a base wall and four sidewalls corporately defining a receiving space upwardly. The spring plate disposes on upper surface of the base wall of the shielded shell. The flexible printed circuit board includes a first part received in the receiving space and a second part extending out of shielded shell. Wherein, the first part defines a plurality of conductive pads extending from opposite side edges of the first part in order to contact with pads formed on the bottom of the camera module. A protecting section is integrally formed with the first part and disposes on the periphery of the conductive pads and disconnect therewith.

In accordance with a second embodiment of the present invention, an electrical connector assembly comprises a shielded shell, a spring plate and a flexible printed circuit board. The shielded shell includes a base wall and fours sidewalls corporately defining a receiving space upwardly. The spring plate disposed on upper surface of the base wall of the shielded shell and includes a plurality of contact engaging portion disposed above the base wall. The flexible printed circuit board includes a first part received in the receiving space and a second part extending beyond the receiving space. Wherein, the first part includes a first board section and a plurality of conductive pads extending from the opposite side edges of the first board section. Four edge portions are integrally formed with first board portion between which the conductive pads disposed. A protecting section is formed on upper surface of the first part and includes a second board section and two pair of wings. Wherein, the second board section and the four wings is configures an H-shape. The second board section is abutting against the upper surface of the first board section; while each wing is abutting against each edge portion thereof, thereby the conductive pads are protected by the protecting section and prevent the conductive pads from being scraped during the production, assembly and the like.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

A shielded connector assembly according to the present invention is applicable to an electronic apparatus such as digital cameras, PDAs (Personal Digital Assistants), PCs (Personal Computers), mobile phones or the like. In the first embodiment illustrated in FIGS. 1-7, the shielded connector assembly is used in a mobile handset (not shown) for transferring the signal of the camera module to a printed circuit board via a flexible printed circuit board.

Figure 1:
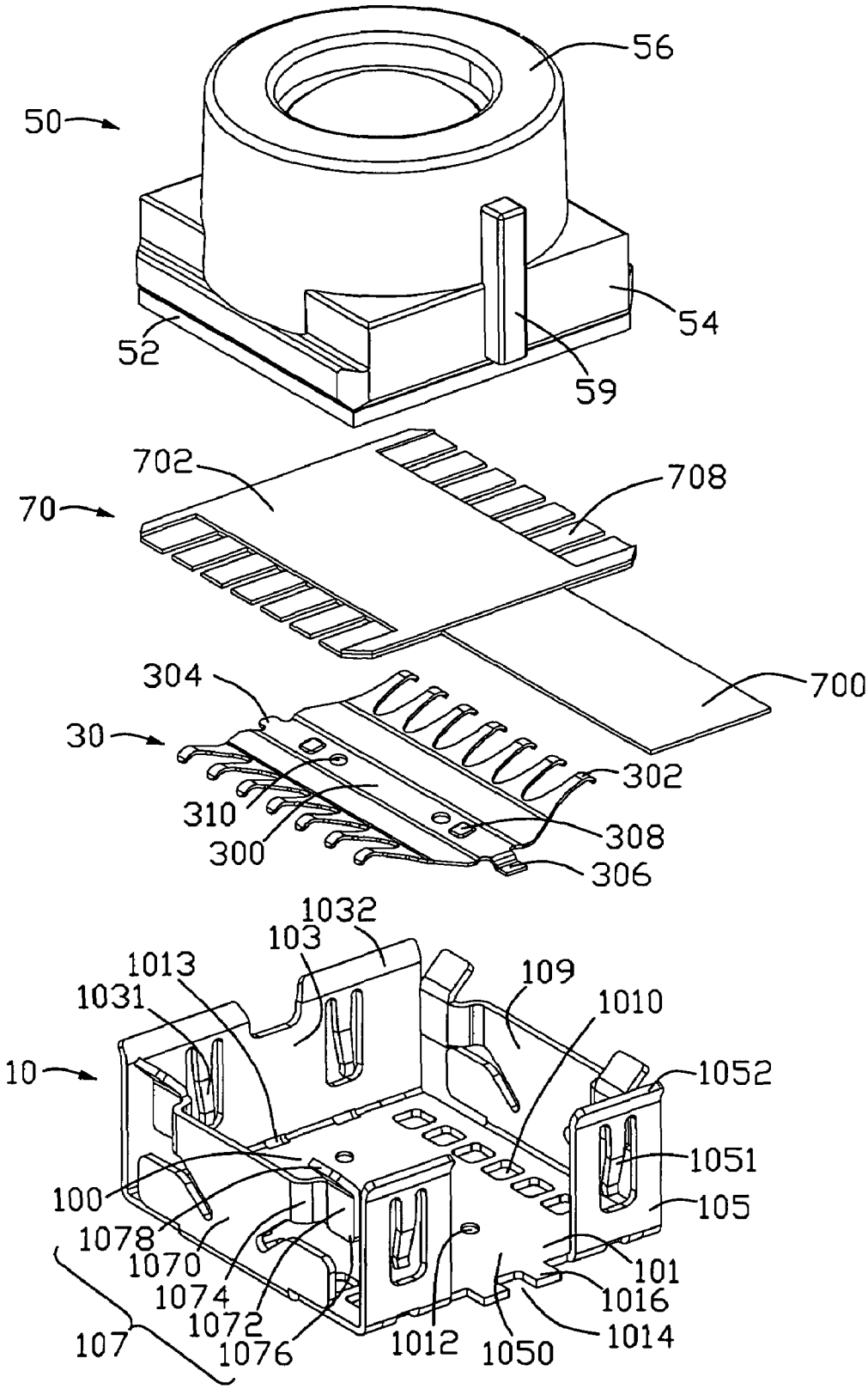
FIG. 1 is a perspective view of a shielded connector assembly according to the first embodiment of the present invention.
Figure 2:
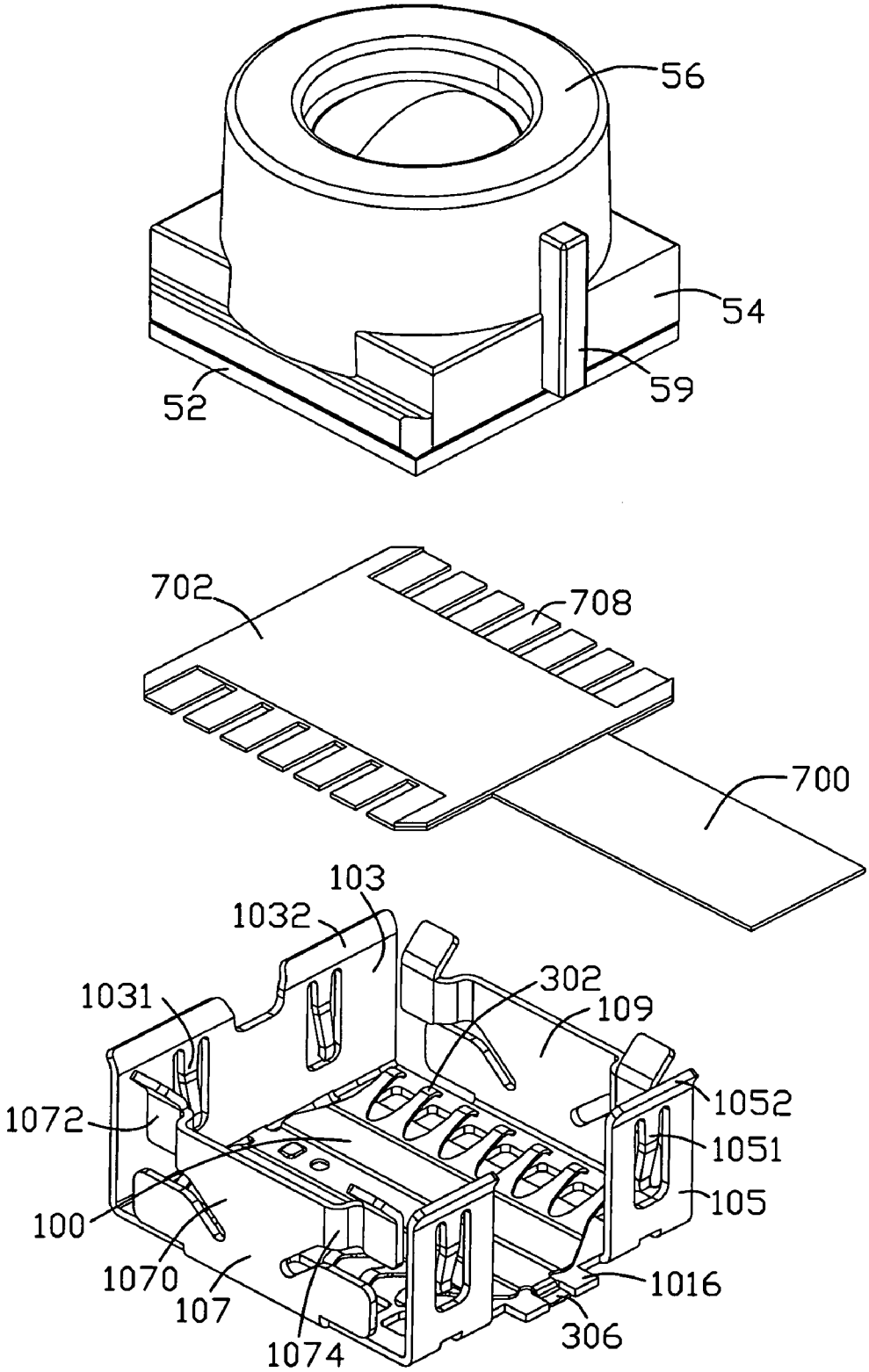
FIG. 2 is an another perspective view of the shielded connector assembly of FIG. 1, wherein the flexible printed board and the camera module are not assembled in the shielded shell.
Figure 3:
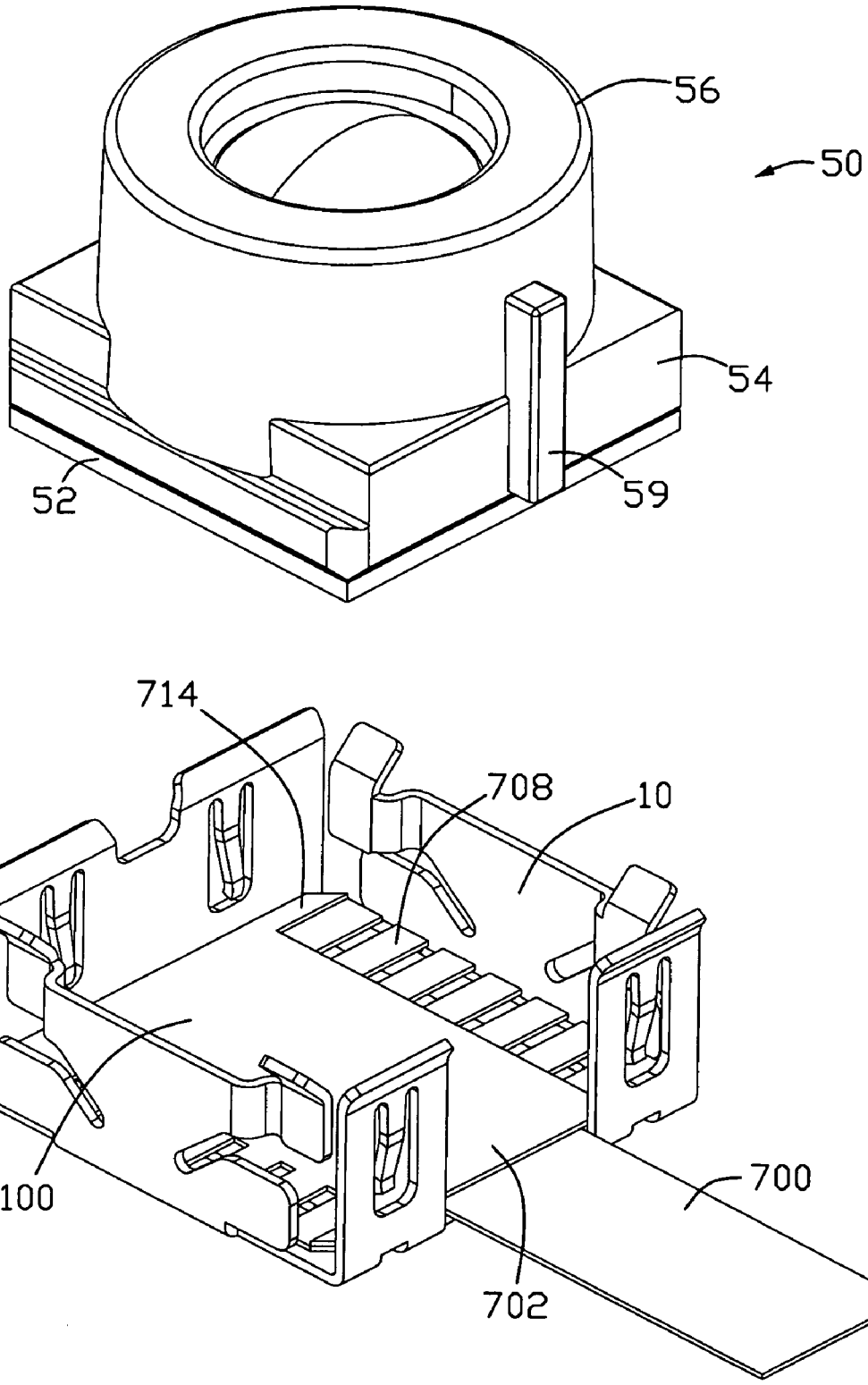
FIG. 3 is a perspective view of a shielded connector assembly of FIG. 1, wherein the flexible printed board has been assembled therein and the camera module has not assembled therein.
Figure 4:
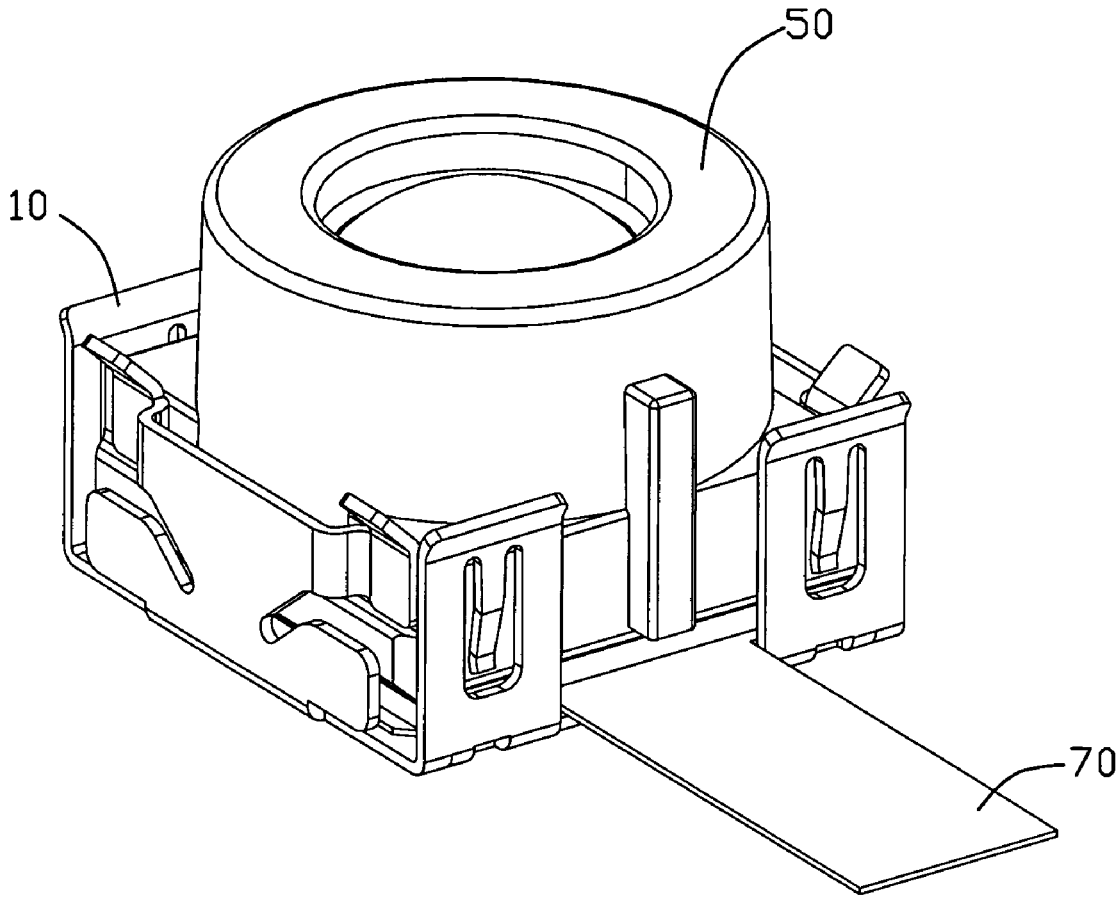
FIG. 4 is a perspective view of a shielded connector assembly of FIG. 1, wherein the flexible printed board and the camera module has been assembled therein.

FIG. 1 is a perspective view of the shielded connector assembly according to the first embodiment of this invention in order to receive a camera module via a flexible printed circuit board. In the figures, the reference numeral 10 denotes a shielded shell made of a metal material. The reference numeral 30 denotes a spring plate detachable from the shielded shell. The reference numeral 70 denotes a flexible printed circuit board and the reference numeral 50 denotes a camera module.

The shielded shell 10 is made of metal material and configured by front wall 103, back wall 105, left wall 107, right wall 109 and a base wall 101 cooperatively defining a receiving space 100. Each front wall 103, back wall 105, left wall 107 and right wall 109 extends upwardly from the peripheral of the base wall 101 and the adjacent walls of the said walls did not connect with each other so as to improve the elastic property of the shielded shell 10 and retain the camera module 50 steadily.

Each of the front and back wall 103, 105 defines a locking finger 1031, 1051 extending from the inner surface thereof to the opposite walls for holding the camera module 50 and the end of the locking finger 1031, 1051 smoothly curved inwardly in order to prevent the camera module 50 from being scraped. Further more, the back wall 105 defines a window 1050 passing through the top thereof to the down so as to provide a path for the flexible printed circuit board 70 passing through.

The left and right wall 107, 109 has the same structure, each including a fixed section (not labeled) and an elastic section 1070. The fixed section connects to the base wall 100 and the elastic section 1073 extends upwardly from the middle portion of the up edge of the fixed section and comprises a board portion (not shown) connected to the fixed section and a pair of retaining portions 1072 extending from the two side ends of the board portion to an opposite wall. Each of the retaining portions 1072 defines a holding portion 1076 vertical to the base wall 100 of the shielded shell 10 so as to abut against the peripheral of the camera module 50. A slant portion 1078 is formed on the top end of the holding portion 1076 and formed an angle with the holding portion 1076 to lead the inserting of the camera module 50. And a connection portion 1074 is formed between the board portion and the retaining portion 1072. Further more correspond to the slant portion 1078 of the left and right wall 107, 109, each of the front and back wall 103, 105 defines a leading portion 1032, 1052 on the end thereof to guide the mounting of the camera module 5.

A plurality of grooves 1010 are formed on the base wall 101 and disposes on a region which is adjacent to the left and right wall 107, 109. A first hole 1012 is formed on the base wall 101 and disposed between the two rows of the grooves 1010.

The spring plate 30 is made of metal material and disposed on upper surface of the base wall 101 of the shielded shell 10. The spring plate 30 comprises a main board 300 and a plurality of contact engaging portions 302 extending from the two opposite side edges of the main board 300 and away therefrom. A pair of second holes 310 is formed on the main board 300 corresponding with the first holes 1012. A dimple 308 is formed on the main board 300 and adjacent to each second hole 310. Moreover, the main board 300 further defines a first and second retaining portion 304, 306, separating extending from the two ends of the main board 300 along the connecting line of the dimples 308. Wherein, the first retaining portion 304 has a same height with the main board 300, while the second retaining portion 306 extending downwardly from the end of the main board 300. Accordingly, the shielded shell 10 defines a slot 1013 corresponding with the first retaining portion 304 of the spring plate 30; the base wall 101 of the shielded shell 10 defines a pair of arm 1016, farther extending forwardly from the edge of the base wall 101 and opposite to the slot 1013. A gap 1014 is formed between the arms 1016 so as to receive the second retaining portion 306 of the spring plate 30.

Figure 5:
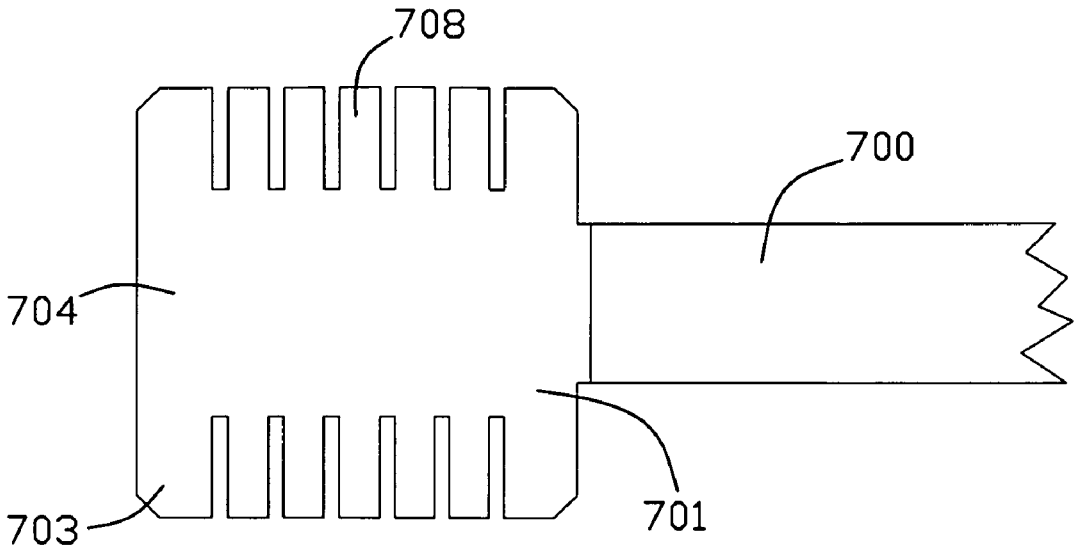
FIG. 5 is a perspective view of the flexible printed board of FIG. 1.
Figure 6:
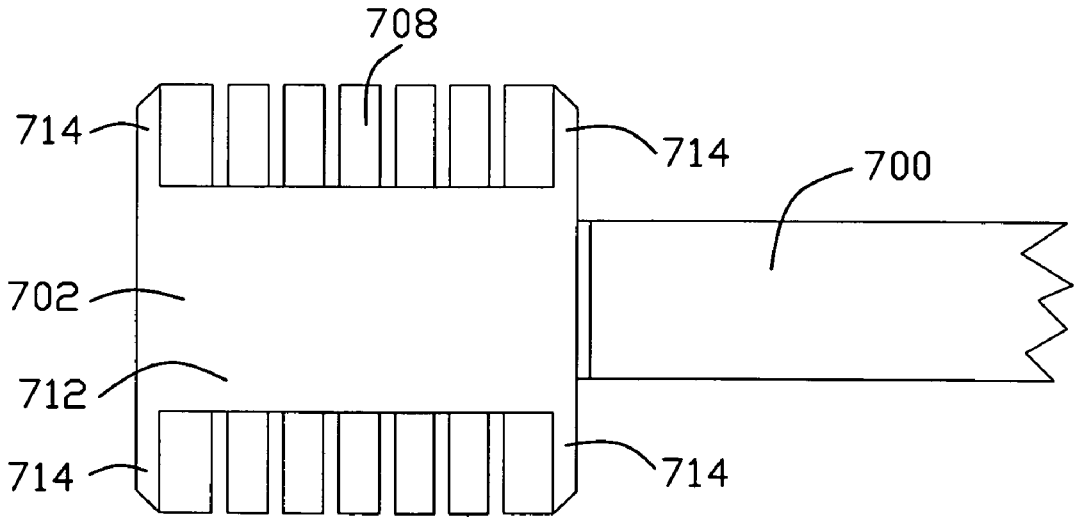
FIG. 6 is a perspective view of the flexible printed board and the protecting portion.
Figure 7:
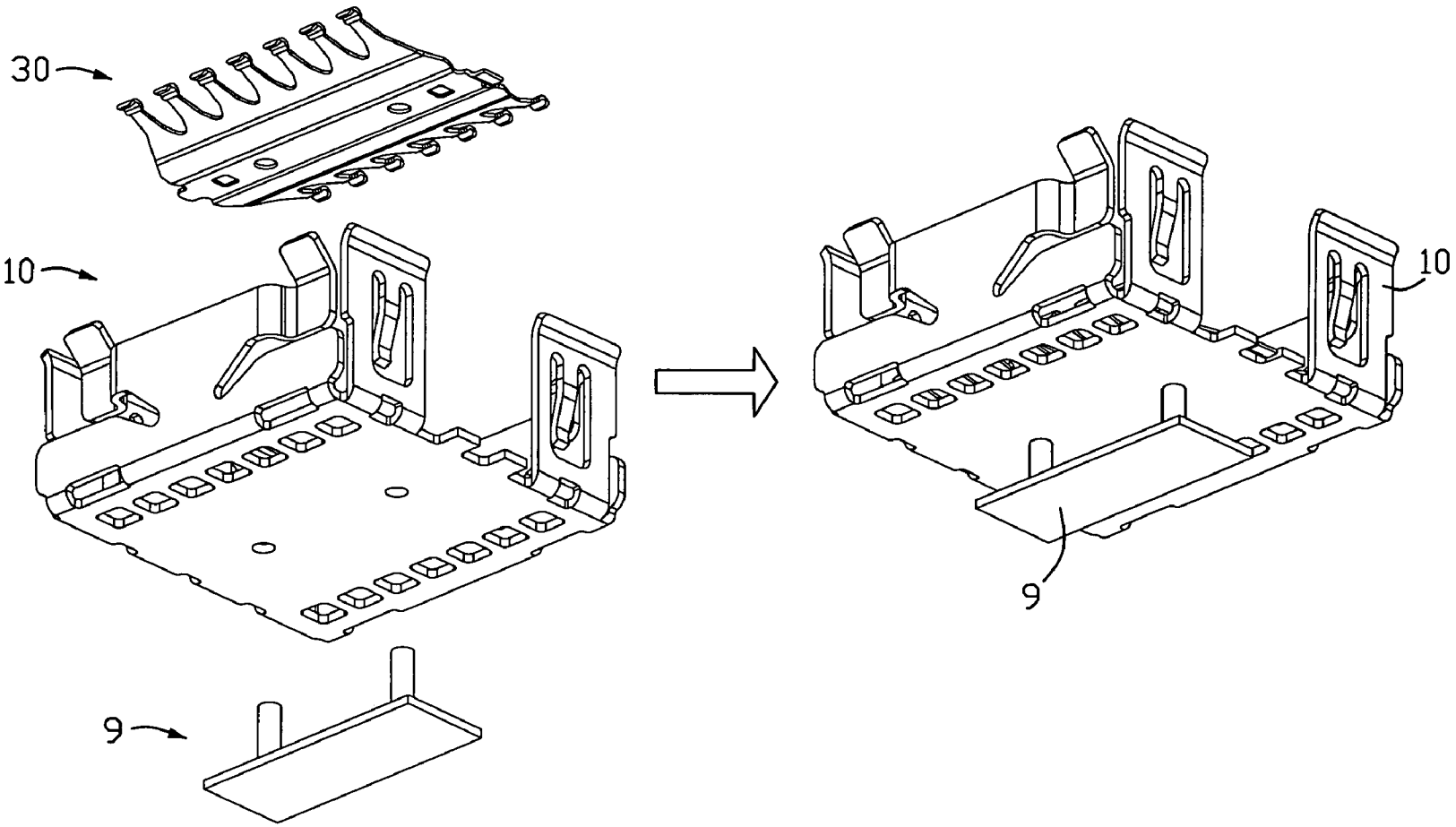
FIG. 7 is a flow chart view of the shielded shell and the spring plate of the present invention.

Please especially referring to the FIGS. 5-6, the flexible printed circuit board 70 comprises a first section 701 received in the receiving space 100 of the shielded shell 10 and a second section 700 extending beyond the receiving space 100 via the window 1050 of the shielded shell 10. The first section 701 comprises a first plate portion 704 and a plurality of conductive pads 708 extending from the opposite edges of the first plate portion 704 and away therefrom. Said conductive pads separates with each other and corresponding to the contact engaging portion 302 of the spring plate 30. Moreover, the first plate portion 704 of the first section 701 defines two pair of edge portions 703. The conductive pads 708 in one line dispose between the pair of edge portions 703.

Additionally, the first section 701 has an equivalent dimension with the receiving space 100 of the shielded shell 10 and the width of the second section 700 is smaller than that of first section 701 and equal to the width of the window 1050 of the shielded shell 10 so as to prevent the flexible printed circuit board 70 from being pushed out from the receiving space 100.

A protecting element 702 attached on upper surface of the first section 701 of the flexible printed circuit board 70, comprising a second plate portion 712 and two pair of wings 714. The second plate portion 712 abut against the upper surface of the first plate portion 704 of the first section 701 of the flexible printed circuit board 70, while each wing 714 abutting against each edge portion 703 of the first plate portion 704. The material rigidity of the protecting element 702 is higher than that of the flexible printed circuit board 70. Therefore, during the manufacture, assembling, and the transporting, what is firstly scraped or distort is the protecting element 702 such that prevent the conductive pads 708 of the flexible printed circuit board 70 from being scraped during production, assembling and the like.

The camera module 50 comprises a base portion 54 which configured as a rectangular, a column portion 56 disposed on a top surface of the base portion 31, and a bottom portion 52 a top surface of which contacts with a bottom surface of the base portion 54. A strip 59 is formed on one side surface of the base portion 54 and extends to the peripheral of the column portion 56 so as to prevent the camera module 50 mismatchable assembling into the receiving space 100 of the shielded shell 10.

A pair of sticks 9 is provided for holding the spring plate 30 on the shielded shell 10. After the shielded shell 10 and the spring plate 30 are combined together, the sticks 9 are removed.

When assembly, firstly, the sticks 9 pass through the first holes 1012 of the shielded shell 10; secondly, the spring plate 30 is assembled on the base wall 101 of the shielded shell 10 and the sticks 9 further pass through the second holes 310 of the spring plate 30, thereby the spring plate 30 is located on the shielded shell 10, meanwhile the main board 300 of the spring plate 30 abutting against an upper face of the base wall 101 of the shielded shell 10, the first retaining portion 304 received in the slot 1013, the second retaining portion 306 received in the gap 1014 and sandwiched between the arms 1016. Thirdly, the shielded shell 10 and spring plate 30 are further connected via spot welding. Finally, the flexible printed circuit board 70 and the camera module 50 is inserted into the receiving space 100 of the shielded shell 10. Wherein, the flexible printed circuit board 70 is sandwiched between the spring plate 30 and the camera module 50. Top face of each conductive pad 708 of the flexible printed circuit board 70 contacts with corresponding pad formed on the bottom surface of the bottom portion 52 of the camera module 50 and bottom face of each conductive pad 708 thereof contacts with corresponding contact engaging portion 302 of the spring plate 30. During the process of the moving of the camera module 50, the contact engaging portion 302 of spring plate 30 does not deform till the bottom portion 52 of the camera module 50 is abut against with the dimple 308 of the spring plate 30. At this moment, the camera module 50 is completely fitted into the shielded shell 10 and the flexible printed circuit board 70 is sandwiched between the spring plate 30 and the camera module 50 firmly, meanwhile, the signal of the camera module 50 is transferred to the printed circuit board (not shown) via the flexible printed circuit board 70.

Figure 8:
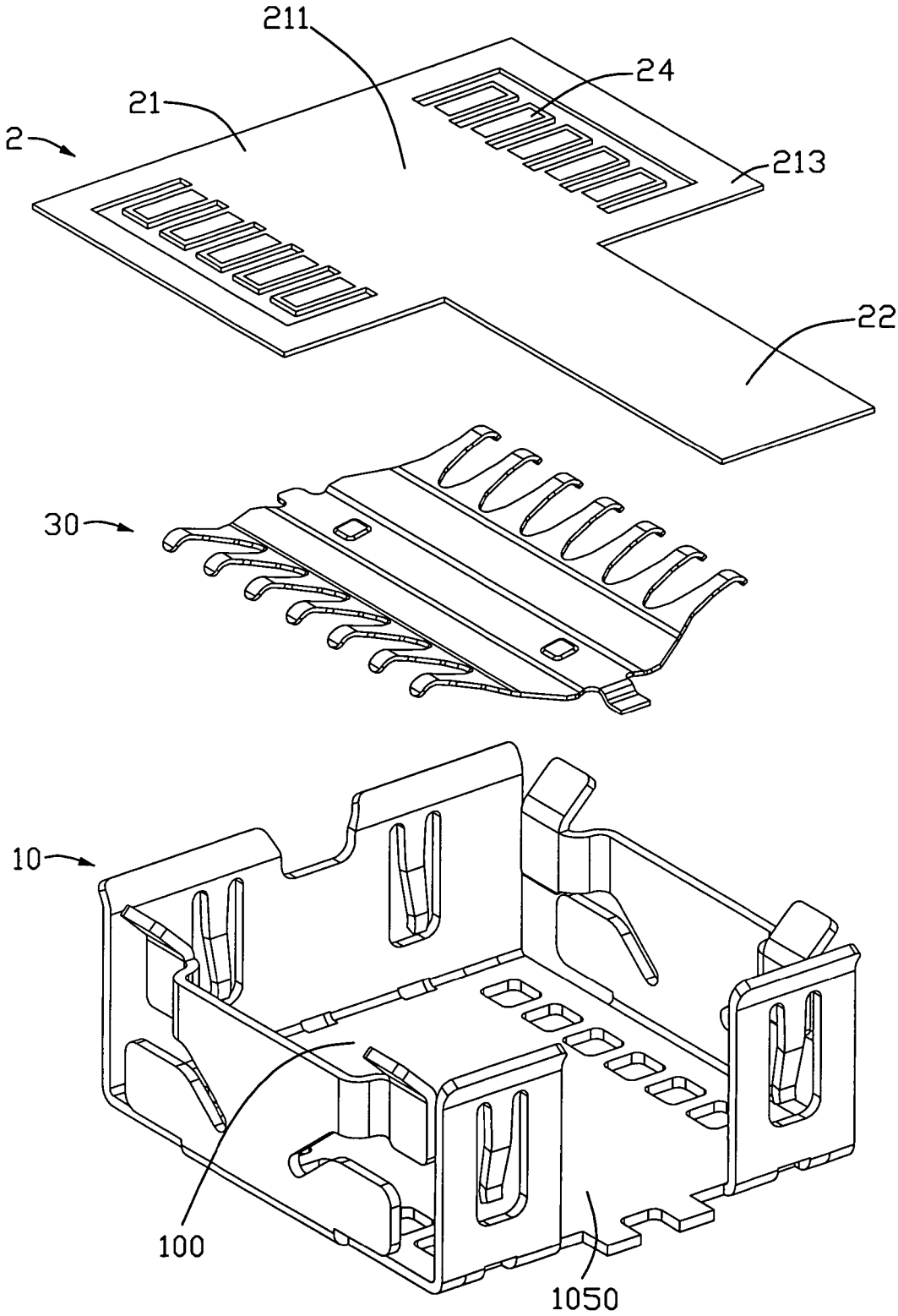
FIG. 8 is a perspective view of the shielded connector assembly according to a second embodiment of the present invention.

Please refer to the FIG. 8, it shows a shielded connector assembly according to a second embodiment of present invention. Herein, I only introduce the flexible printed circuit board 2 which is different from the first embodiment. Same to the first embodiment, the flexible printed circuit board 2 comprises a first section 21 received in the receiving space 100 of the shielded shell 10 and a second section 22 extending beyond the receiving space 100. The first section 21 includes a plate portion 211 and a plurality of the conductive pads 24 extending from two opposite edges of the plate portion 211 and away therefrom. A protecting portion 213 is configured as a U-shape and integrally formed with the plate portion 211. And said protecting portion 213 encloses the conductive pads 24 of the first section 21 and disconnects therewith. Additionally, the first section 21 has an equivalent dimension with the receiving space 100 of the shielded shell 10 and the width of the second section 22 is smaller than that of first section 21 and equal to width of the window 1050 of the shielded shell 10 so as to prevent the flexible printed circuit board 2 from being pushed out from the receiving space 100.

In the above description of the preferred embodiment, the flexible printed circuit board defines a protecting portion. In the second embodiment, the protecting portion is integrally formed with the plate portion of the flexible printed circuit board 70 and encloses the conductive pads thereof. In the first embodiment, the protecting portion disposes on the first plate portion and comprises a second plate portion and two pair of wings, wherein each wing abutting against each edge portion. Moreover, the material rigidity of the protecting portion is higher than that of flexible printed circuit board. As a result, during the manufacture, assembling, and the transporting, that which is firstly scraped or distort is the protecting element 702 so as to prevent the conductive pads from being scraped during production, assembly and the like.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A shielded connector assembly, comprising:

a shielded shell having a bottom wall and four side walls cooperatively defining a receiving space therebetween;

a spring plate disposed on the base wall of the shielded shell; and a flexible printed circuit board including a first section received into the receiving space of the shielded shell and a second section extending beyond of the receiving space;

wherein the first section of the flexible printed circuit board includes a plate portion and a plurality of conductive pads extending laterally by two sides of the plate portion and positioning within a receiving opening of the first section, a protecting portion being laterally integrally formed with the plate portion and enclosing the conductive pads under a spatial relation therewith such that the conductive pads were not scraped.

2. The shielded connector assembly according to claim 1, wherein the protecting portion is configured as a U-shape.

3. The shielded connector assembly according to claim 1, wherein the protecting portion is configured as an H-shape.

4. The shield connector assembly according to claim 1, wherein the protecting portion sandwiches the corresponding row of conductive pads in the longitudinal direction.

5. A shielded connector assembly comprising:

a metallic shell defining a bottom wall and a plurality of side walls commonly defining a receiving space;

a flexible printed circuit board including a first section received in the receiving space, and a second section extending from the first section and out of the receiving space;

the first section including a center portion with two rows of conductive pads extending laterally by two longitudinal sides thereof and positioning within a receiving opening of the first section under a condition that a plurality of contact engaging portions, which are respectively located under the corresponding conductive pads, upwardly press the corresponding conductive pads, respectively;

a pair of edge portions extending along two lateral sides of the center portion of the first section and essentially sandwiching said conductive pads therebetween in a longitudinal direction; and a protective element is configured to complement with a sub-assembly of the center portion and the pair of edge portions so as to unitarily laterally extend from said pair of edge portions for cooperating with the sub-assembly to circumscribe the conductive pads in a coplanar manner.

6. The shielded connector assembly according to claim 5, wherein said contact engaging portions extends from a spring plate which is discretely disposed upon the bottom wall.

7. The shield connector assembly according to claim 5, wherein the protective element is stacked and upwardly exposed upon the sub-assembly.

8. The shield connector assembly according to claim 5, wherein said sub-assembly is of an "I" shape in a top view, and the protective element is configured to have said same "I" shape thereof.

* * * * *